US010400414B2

(12) United States Patent
Mack

(10) Patent No.: US 10,400,414 B2
(45) Date of Patent: Sep. 3, 2019

(54) METHOD OF INSTALLING A PILE BY MEANS OF A PILE GUIDE

(71) Applicant: IHC IQIP UK LTD, Dorset (GB)

(72) Inventor: James Ewart Milligan Mack, Dorset (GB)

(73) Assignee: IHC IQIP UK LTD, Dorset (GB)

( * ) Notice: Subject to any disclaimer, the term of this patent is extended or adjusted under 35 U.S.C. 154(b) by 0 days.

(21) Appl. No.: 15/567,466

(22) PCT Filed: Apr. 19, 2016

(86) PCT No.: PCT/EP2016/058634
§ 371 (c)(1),
(2) Date: Oct. 18, 2017

(87) PCT Pub. No.: WO2016/169923
PCT Pub. Date: Oct. 27, 2016

(65) Prior Publication Data

US 2018/0106007 A1 Apr. 19, 2018

(30) Foreign Application Priority Data

Apr. 22, 2015 (NL) ..... 2014689
Jul. 29, 2015 (NL) ..... 2015237

(51) Int. Cl.
*E02D 13/00* (2006.01)
*E02D 7/02* (2006.01)
(Continued)

(52) U.S. Cl.
CPC ..... *E02D 13/04* (2013.01); *E02D 7/02* (2013.01); *E02D 27/52* (2013.01); *E02D 5/24* (2013.01); *E02D 2200/1685* (2013.01)

(58) Field of Classification Search
CPC ... E02B 17/0017; E02D 13/00; E02D 13/005; E02D 13/04; E02D 27/42; E02D 13/50;
(Continued)

(56) References Cited

U.S. PATENT DOCUMENTS 2,422,168 A * 6/1947 Kirby ..... E02B 17/0004 405/205
2,580,299 A * 12/1951 Hunicke ..... E02D 13/06 73/11.03
(Continued)

FOREIGN PATENT DOCUMENTS

CN 103590403 A 2/2014
EP 2834423 A2 2/2015
(Continued)

OTHER PUBLICATIONS

International Search Report dated Jul. 18, 2016 for corresponding International Application PCT/EP2016/058634, filed Apr. 19, 2016.
(Continued)

*Primary Examiner* — Benjamin F Fiorello
*Assistant Examiner* — Edwin J Toledo-Duran
(74) *Attorney, Agent, or Firm* — Steven M. Koehler; Westman, Champlin & Koehler, P.A.

(57) ABSTRACT

In a method of installing a pile in the sea bottom by means of a pile guide which has a frame and at least an upper and a lower pair of cooperating guide members, wherein the upper pair and the lower pair are located at a distance from each other in vertical direction. Each pair of guide members comprises a passive guide member and an active guide member. The passive guide members are moved to respective fixed initial guiding positions with respect to the frame and the active guide members are moved to the pile until the passive and the active guide members engage the pile, after which the pile is hold between the upper pair of guide
(Continued)

members and between the lower pair of guide members during driving the pile into the sea bottom, during which the actual forces between the pile and the respective guide members are determined.

18 Claims, 1 Drawing Sheet

(51) Int. Cl.
*E21B 41/08* (2006.01)
*E02D 13/04* (2006.01)
*E02D 27/52* (2006.01)
*E02D 5/24* (2006.01)

(58) Field of Classification Search
CPC ... E02D 7/02; E02D 27/52; E02D 2200/1685; E02D 5/24; E21B 41/08
USPC ..... 405/203, 211, 216, 224, 227, 228
See application file for complete search history.

(56) References Cited

U.S. PATENT DOCUMENTS 3,001,370 A * 9/1961 Templeton ..... E02B 17/021 114/265
3,294,051 A * 12/1966 Khelstovsky ..... B63B 35/4413 114/265
3,502,159 A * 3/1970 Pogonowski ..... E02B 17/027 173/193
3,597,930 A * 8/1971 Rochelle ..... E02B 17/00 405/211
3,611,734 A * 10/1971 Mott ..... B63B 21/50 114/265
3,832,858 A * 9/1974 Anders ..... E02D 7/26 173/24
3,871,617 A * 3/1975 Majima ..... E02D 7/20 173/205
3,888,317 A * 6/1975 Walters ..... E02D 7/16 173/193
4,102,147 A 7/1978 Jansz
4,214,843 A * 7/1980 Rohde ..... E02B 17/0008 405/203
4,540,314 A * 9/1985 Falkner, Jr. ..... B63B 21/502 114/265
4,589,802 A * 5/1986 Hampton ..... E21B 7/128 405/224
4,674,920 A * 6/1987 Regan ..... E02B 17/00 405/227
4,687,062 A * 8/1987 Beghetto ..... E21B 41/08 166/366
4,768,899 A * 9/1988 Dysarz ..... E02D 9/04 166/55
4,906,130 A * 3/1990 Manley, Jr. ..... E02B 3/14 405/15
5,040,607 A * 8/1991 Cordeiro ..... E21B 43/017 166/339
5,040,927 A * 8/1991 Wickberg ..... E02D 7/20 173/189
5,409,326 A * 4/1995 Ku ..... E02D 13/04 405/114
5,722,796 A * 3/1998 Halvorsen ..... E21B 43/017 166/341
6,354,767 B1 * 3/2002 Jones ..... E02D 13/04 405/228
6,749,371 B2 * 6/2004 Jones ..... E02D 13/04 405/228
6,994,493 B2 * 2/2006 Jones ..... E02D 13/04 405/227
7,476,056 B2 * 1/2009 Dreyer ..... F16L 55/0336 405/211
8,672,587 B2 * 3/2014 Mack ..... E02D 31/002 405/227
8,801,334 B2 * 8/2014 Paulus ..... E02D 13/04 405/224
8,834,071 B2 * 9/2014 Vandenbulcke ..... E02D 13/04 405/224
8,926,226 B2 * 1/2015 Vandenbulcke ..... E02D 13/04 166/352
9,394,664 B2 * 7/2016 Desmeules ..... E02D 7/06
9,869,071 B1 * 1/2018 Mohrfeld ..... E02D 5/24
9,945,089 B2 * 4/2018 Van Vessenn ..... E02D 13/04
2005/0023014 A1 * 2/2005 Bermingham ..... E02D 7/02 173/2
2007/0074881 A1 * 4/2007 Bermingham ..... E02D 7/02 173/2
2011/0299938 A1 * 12/2011 Jung ..... E02D 13/00 405/228
2012/0014753 A1 * 1/2012 Jung ..... E02D 13/00 405/227
2012/0315097 A1 * 12/2012 Paulus ..... E02D 13/04 405/224
2014/0193209 A1 7/2014 Mack
2015/0110564 A1 * 4/2015 West ..... E02B 17/0017 405/227
2015/0308139 A1 * 10/2015 Wagner ..... F03D 13/20 52/1
2017/0175347 A1 * 6/2017 Bermingham ..... E01D 21/06
2017/0275845 A1 * 9/2017 Belder ..... E02D 7/02
2019/0048551 A1 * 2/2019 Boot ..... E02D 13/04

FOREIGN PATENT DOCUMENTS

WO 2013014416 A1 1/2013
WO 2013144659 A2 10/2013

OTHER PUBLICATIONS

Written Opinion of the International Searching Authority dated Oct. 27, 2016 for corresponding International Application PCT/EP2016/058634, filed Apr. 19, 2016.
Chinese Office Action for Chinese patent application No. 201680022642.9, dated May 5, 2019, with English translation.

* cited by examiner

METHOD OF INSTALLING A PILE BY MEANS OF A PILE GUIDE

CROSS-REFERENCE TO RELATED APPLICATION

The present application is a national stage of and claims priority of International patent application Serial No. PCT/EP2016/058634, filed Apr. 19, 2016, and published in English as WO/2016/169923 A1.

BACKGROUND

The present invention relates to a method of installing a pile in the sea bottom by means of a pile guide.

A method of installing a pile in the sea bottom by means of a pile guide is known from U.S. Pat. No. 4,102,147. The pile guide disclosed therein has a frame which carries radially movable inwardly extending guide members for guiding a pile. The guide members comprise hydraulic cylinders having shoes which bear on a part of the circumference of the pile. The pile guide keeps a pile to be driven into the ground in an upright position under water.

SUMMARY

A method for installing a pile in the sea bottom in a fast and accurate manner is disclosed. The pile guide has a frame and at least an upper and a lower pair of cooperating guide members, wherein the upper pair and the lower pair are located at a distance from each other in vertical direction, wherein each pair of guide members comprises a passive guide member and an active guide member, and wherein the passive guide member and active guide member are moved towards the pile after placing the pile between each of the pairs of guide members. Furthermore, the passive guide members are moved to respective fixed initial guiding positions with respect to the frame and the active guide members are moved to the pile until the passive and the active guide members engage the pile, after which the pile is held between the upper pair of guide members and between the lower pair of guide members during driving the pile into the sea bottom, during which the actual forces between the pile and the respective guide members are determined.

An advantage of the method is that the passive guide members can be moved quickly from releasing positions thereof towards the pile to their fixed initial guiding positions, whereas the active guide members are used for engaging the pile by the guide members. It is possible to exert a small pressure on the pile by the active guide members such that the pile is clamped between the upper pair of guide members as well as between the lower pair of guide members. Measuring the actual force between the pile and the respective guide members provides feedback signals which provide the opportunity to control the positions of the active guide members with respect to the frame and under certain circumstances the passive guide members, as well. In this way a relatively low pressure can be maintained on the pile by the guide members during the pile driving process such that the clamping force is sufficient to hold the pile whereas excessive clamping force is avoided in order to minimize resistance between the guide members and the pile during displacing the pile downwardly. Since a sudden excessive clamping force can be prevented, clearance between the pile and the guide members to avoid jamming can be minimized or even omitted.

At a final stage of a pile driving action the guide members may be moved in a direction away from the pile, back to their releasing positions in order to form a passage for a hammering device and/or to remove the pile guide from the pile which has been driven into the ground.

In a practical situation before starting the process of driving the pile into the sea bottom the pile guide is placed on the sea bottom and possibly levelled. Then, the pile is transferred by means of a crane to the pile guide and placed between the guide members of the upper pair of guide members and between the guide members of the lower pair of guide members. In this situation the guide members are still in a releasing position at a radial distance from the pile in order to provide sufficient space to receive the pile between the guide members of the respective pairs of guide members. The pile is lowered towards the sea bottom and the crane holds the pile just above the sea bottom or the pile rests on the sea bottom. Subsequently, the guide members of the upper pair and the guide members of the lower pair are moved towards each other, respectively, i.e. the guide members are moved from their respective releasing positions towards the pile. The passive guide members are first moved to a fixed guiding position with respect to the frame whereas the active guide members are subsequently moved to the pile until predetermined actual forces between the pile and the respective guide members are reached. Under ideal pile driving conditions, in case the pile is more or less cylindrical, the passive guide members keep their initial fixed guiding positions and the positions of the active guide members may be varied. However, under certain conditions the positions of the passive guide members can be changed as well. The actual forces between the pile and the respective guide members can be determined by means of strain gauges at the respective guide members, for example.

Although the passive guide members are moved to respective fixed guiding positions with respect to the frame after placing the pile between each of the pairs of guide members, the respective fixed positions are not necessarily located exactly above each other. For example, it is possible that their positions are inclined with respect to a vertical line in order to drive the pile inclined into the bottom.

In a specific embodiment, during pile driving the active guide member of at least one pair of guide members is initially moved in a direction away from the pile if the actual forces at both the passive and active guide member of that pair increase without moving the passive guide member, but the passive guide member of that pair is moved in a direction away from the pile if the actual force at the passive guide member remains above a certain level without increase of the actual force at the active member. This situation may typically occur if the pile diameter is locally larger which results in increasing actual forces between the pile and the respective guide members during pile driving, first occurring at the upper pair of guide members. If the actual forces exceed respective predetermined threshold levels the active guide member of the upper pair may be moved in a direction away from the pile as a first response in order to alleviate the increasing clamping force between the corresponding guide members. Initially the position of the passive guide member remains unchanged. However, if the actual force at the passive guide member remains above a certain level whereas the actual force at the active member does not increase the passive guide member is moved in a direction away from the pile. A similar method can be performed at the lower pair of guide members after the portion of the pile with increased diameter has passed the upper pair.

Furthermore, during pile driving at least two guide members may be locked in their actual positions if an actual force at one of the guide members of the upper pair and an opposite actual force at one of the guide members of the lower pair both increase whereas the actual forces at the remaining guide members do not increase, wherein at least the guide members are locked where the respective actual forces increase. This situation may typically occur in case of leaning of the pile causing increased actual forces at one of the guide members of the upper pair and one of the guide members of the lower pair, which actual forces are directed in opposite directions. Locking the guide members means that their positions with respect to the frame are maintained.

In a specific embodiment, during pile driving the method comprises the following step:

if the actual force at the active guide member of one of the pairs of guide members decreases, then the active guide member of that pair of guide members is moved in the direction of the pile, and the following step:

if the actual force at the passive guide member of one of the pairs of guide members decreases, then the active guide member of that pair of guide members is moved in the direction of the pile, but if the actual force at the passive guide member of that pair of guide members remains below a predetermined level upon moving the active guide member of that pair of guide members in the direction of the pile, then the passive guide member of that pair of guide members is moved in the direction of the pile. This situation may typically occur if the pile diameter is locally smaller which results in decreasing actual forces between the pile and the respective guide members during pile driving, first occurring at the upper pair of guide members. Similar as in case of increasing pile diameter, it is initially attempted to compensate the diameter variation by means of moving the active guide member.

Preferably, the guide members are operated hydraulically, since this provides the opportunity to control the guide members rapidly, reliably and accurately.

The locations where resultant forces of the guide members engage the pile may lie in a common plane. This results in symmetrical forces on the pile such that a torque about a centreline of the pile is avoided, for example.

The passive guide members of both pairs of guide members may be located at the same side of the centerline of the pile. The passive guide members of the upper and lower pair of guide members may be located above each other and the active guide members of the upper and lower pair of guide members may be located above each other.

In a specific embodiment the pair of upper guide members form a first pair of upper guide members, wherein a second, similar pair of upper guide members are located in a plane perpendicular to the common plane, and wherein the pair of lower guide members form a first pair of lower guide members, wherein a second, similar pair of lower guide members are located in a plane perpendicular to the common plane. This provides the opportunity to guide the pile accurately and at low resistance in two horizontal directions which are perpendicular to each other.

The invention is also related to a pile guide for guiding a pile during submerged pile driving, comprising a frame including a passage for receiving a pile, at least two guide members for guiding a pile, which guide members are moveable with respect to the frame between respective guiding positions and respective releasing positions, wherein in the guiding positions the guide members project into the passage and face each other, and wherein in the releasing positions the guide members are located at a larger distance from each other than in the respective guiding positions, wherein at least one of the guide members is a passive guide member having a fixed guiding position.

The other guide member may be an active guide member having a flexible guiding position. This is advantageous in case of using piles having varying manufacturing tolerances. For example, the pile diameter may vary from pile to pile, but it is also possible that the diameter of the pile varies in longitudinal direction thereof. Since the passive guide member has a fixed guiding position it is only the active guide member which has to be controlled towards a desired guiding position.

At least one of the passive guide member and the active guide member may be moveable between its guiding position and releasing position by a hydraulic cylinder.

The passive guide member may be movable by a hydraulic cylinder and pushed to a fixed end position in its guiding position. For example, the piston of the hydraulic cylinder may achieve a stop or the piston may reach its maximum extension in the guiding position of the passive guide member. This makes control of the hydraulic cylinder for moving the passive guide member simple.

The active guide member may be movable by a hydraulic cylinder, whereas its guiding position is controlled by control of actual hydraulic pressure in the corresponding hydraulic cylinder. This provides the opportunity to select a continuously variable guiding position of the active guide member. Besides, the pile may be clamped tighter between the passive guide member and the active guide member by increasing hydraulic pressure in the cylinder that moves the active guide member.

The hydraulic cylinder for moving the passive guide member may operate at a higher pressure than the hydraulic cylinder for moving the active guide member.

The other guide member may also be a passive guide member having a fixed guiding position. This embodiment is typically suitable for piles having stable dimensions from pile to pile and in longitudinal direction of each pile. After receiving a pile in the passage both passive guide members can be quickly moved to their fixed guiding positions and a pile driving action can be started.

The passive guide members may be moveable between their respective guiding positions and their respective releasing positions by respective hydraulic cylinders, wherein the passive guide members are pushed to their fixed end positions in their respective guiding positions.

Both guide members may be located opposite to each other in their guiding positions, forming a cooperating pair of guide members. The guiding positions may be matched to the dimensions of the pile to be driven into the sea bottom such that a clamping force on the pile exists after the passive guide members have reached their guiding positions.

It is noted that the guide members may also be located opposite to each other in their releasing positions. This may be the case if the guide members are moved by means of hydraulic cylinders which are substantially aligned such that in extended condition as well as in retracted condition the guide members face each other.

In a specific embodiment the pair of guide members form a first pair of guide members and a second, similar pair of guide members are located in a plane perpendicular to a plane extending in longitudinal direction of the passage and in which said first pair of cooperating guide members are located.

The pair of guide members may form a first pair of guide members, wherein a third, similar pair of guide members are located at a distance from the first pair of guide members in longitudinal direction of said passage. This provides the opportunity to support a pile in a desired upright position in the guiding positions of the guide members. It is noted that the guiding positions of the guide members may be selected such that the pile has an inclined orientation rather than an exact vertical orientation.

At least one of the guide members may comprise a roller for guiding a pile. This minimizes friction between the pile and the guide member during pile driving. Due to low friction of rollers a higher clamping force on the pile is allowable.

The frame may comprise a cylindrical guide sleeve which envelopes the passage. In practice the guide sleeve as well as the piles may have a circular cross-section.

At least one of the guide members may be movable by a hydraulic cylinder which is connected to an accumulator for relieving the guide member above a predetermined hydraulic pressure. For example, if the pile diameter increases along its length, a too high force might be exerted onto the guide member and the pile during pile-driving. Due to the presence of the accumulator, any over pressure in the hydraulic system can be absorbed in order to safeguard the pile and the pile guide.

The invention is also related to a method of installing a pile in the sea bottom by means of the pile guide as described hereinbefore, wherein the pile guide is placed onto the sea bottom and the guide members are located in their releasing positions before a pile is placed into the passage on the sea bottom or just above the sea bottom, wherein the guide members are moved towards the pile to their guiding positions in which they contact and guide the pile during driving the pile into the sea bottom, wherein the passive guide member is moved to its guiding position, independent from the other guide member.

BRIEF DESCRIPTION OF THE DRAWINGS

The invention will hereafter be elucidated with reference to schematic drawings showing an embodiment of the invention by way of example.

DETAILED DESCRIPTION

Figure 1:
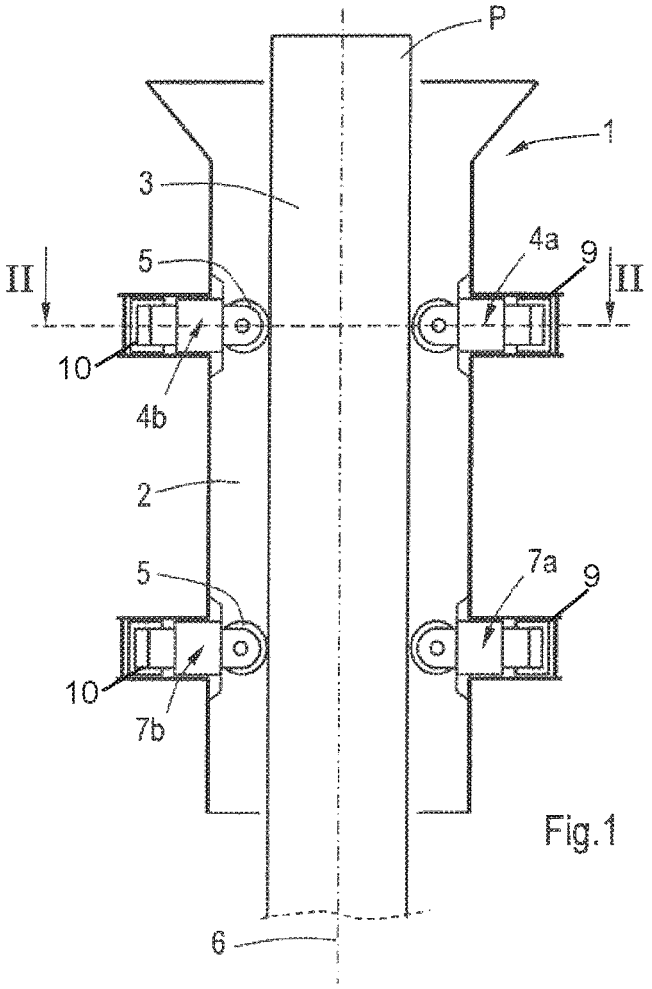
FIG. 1 is a cross-sectional view of a pile guide for illustrating an embodiment of the method of installing a pile.

FIG. 1 shows a pile guide 1 which is suitable for guiding a pile P during submerged pile-driving. Under offshore operating conditions the pile guide 1 is placed on the sea bottom and a pile P which has to be inserted into the sea bottom by means of hammering is guided by the pile guide 1 during pile-driving. The embodiment of the pile guide 1 as shown in FIG. 1 is a simplified representation. In reality the pile guide 1 may be part of a construction which has feet for stable positioning and levelling the pile guide 1 on the sea bottom. The pile guide 1 may also be provided with a lifting element for lifting the pile guide 1. A surface vessel (not shown) having a hoist crane can position and lower the pile guide 1 onto the sea bottom before driving a pile and lift it after pile-driving.

The embodiment of the pile guide 1 as shown in FIG. 1 comprises a frame in the form of a cylindrical guide sleeve 2 which envelopes a passage 3 for receiving the pile P. The guide sleeve 2 has a circular cross-section. The pile guide 1 is provided with eight guide members 4, 7, each having a roller 5 which can roll along the pile P during inserting the pile P into the sea bottom. The guide members 4, 7 are located at two parallel horizontal planes extending perpendicularly to a centerline 6 of the guide sleeve 2. In each of the planes four guide members 4 are disposed at equiangular distance from each other about the centerline 6, which is shown in cross-section of the pile guide 1 in FIG. 2. In this case the centerline 6 coincides with the centerline of the pile P.

Figure 2:
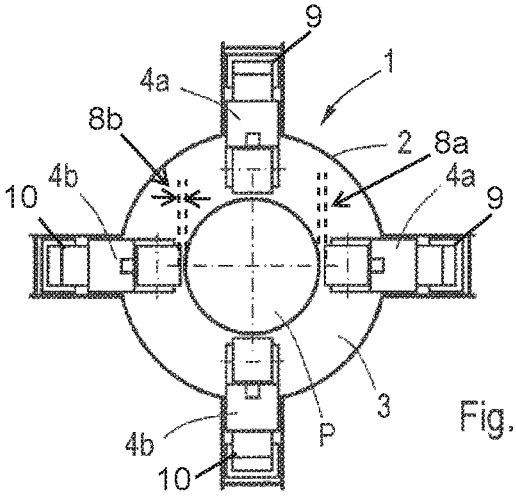
FIG. 2 is a cross-sectional view of the pile guide of FIG. 1 along line II-II in FIG. 1.

Each of the guide members 4, 7 is moveable with respect to the pile P and the guide sleeve 2 between a guiding position and a releasing position. Each guide member 4, 7 can be moved by means of a hydraulic cylinder (two of which are schematically illustrated in FIG. 2 at 9 and 10). In the embodiment as shown in FIG. 1 the guide member 4, 7 is moveable in radial direction to and from the centerline 6. The corresponding hydraulic cylinders 9, 10 extend in radial direction with respect to the centerline 6. FIG. 1 shows the guide members 4, 7 in their guiding positions, in which the rollers 5 project into the passage 3 and contact the pile P. When the guide members 4, 7 are in their releasing positions (FIG. 2) they are moved radially away from the centerline 6 by the hydraulic cylinders 9, 10 such that the pile P is loose from the guide members 4, 7 and the pile guide 1 can be removed from the pile P after installing the pile P. The guide members 4, 7 are also in their releasing positions before receiving the pile P in the passage 3 in order to facilitate inserting the pile P into the passage 3 before pile-driving.

The guide members 4, 7 of the embodiment as shown in FIG. 1 form four pairs of opposite guide members 4*a*, 4*b*, and 7*a*, 7*b*, as illustrated in FIG. 2. Each of the horizontal planes in which four guide members 4 are present has two pairs of passive and active guide members 4*a*, 7*a*, 4*b*, 7*b*. As seen in vertical cross-section, as shown in FIG. 1, the pile guide 1 is provided with an upper pair 4*a*, 4*b* and a lower pair 7*a*, 7*b* of cooperating hydraulically operated guide members 4, 7 which contact and guide the pile P. The upper and lower pair of guide members 4, 7 are located at a distance from each other in vertical direction. The guide members 4*a* and 4*b* of the upper pair face each other at least in their guiding positions, and the guide members 7*a* and 7*b* of the upper pair face each other at least in their guiding positions. In their releasing positions the guide members 4, 7 are located at a larger distance from each other than in their guiding positions. Each pair of opposite guide members 4, 7 comprise a passive guide member 4*a*, 7*a* and an active guide member 4*b*, 7*b*. The passive guide members 4*a*, 7*a* have fixed guiding positions (represented by dashed lines 8*a*) with respect to the guide sleeve 2, which means that upon activating the corresponding hydraulic cylinders 9 the passive guide members 4*a*, 7*a* move to respective fixed locations with respect to the guide sleeve 2. The fixed guiding position corresponds with the maximum extension of a piston of the hydraulic cylinder 9, for example.

The active guide member 4*b*, 7*b* has a flexible guiding position (represented by spacing between dashed lines 8*b*). This means that its position is adjustable by controlling the hydraulic cylinder 10. For example, if a pile P has a slightly different diameter the passive guide member 4*a*, 7*a* of a pair of guide members will still be at its fixed guiding position whereas the guiding position of the active guide member 4*b*, 7*b* will be adapted to the actual different diameter such that the pile P is not deformed by a too high local pressure or such that no gap will arise between the rollers 5 of the opposite guide members 4, 7 and the pile P. The presence of the passive guide member 4*a*, 7*a* provides a fast preparation for pile-driving since it can be moved to its initial fixed guiding position without a complicated hydraulic control.

The guiding position of the active guide member 4*b*, 7*b* is controlled by actual hydraulic pressure in the corresponding hydraulic cylinder 8*b*. In practice, the hydraulic cylinder 9 for moving the passive guide member 4*a*, 7*a* can be operated at a higher pressure than the hydraulic cylinder 10 for moving the active guide member 4*b*, 7*b*.

Both hydraulic cylinders are connected to respective accumulators (not shown) for relieving the guide members 4, 7 above a predetermined pressure. The accumulators prevent over pressure or overload of the pile guide 1 and the pile P in case of guiding a pile P which has a deviating diameter due to fabrication inaccuracy. For example, if the pile shape and diameter varies along its length, during pile-driving these variations must pass the rollers 5. When a larger diameter section of pile P, for example a weld bead, ovality or the like, passes, the rollers 5 must be moved outwardly with respect to each other. This is allowed by the accumulators. Basically, the majority of such a movement will be done by the accumulator cooperating with the active guide member 4*b*, 7*b*, but in case of an increase in pile diameter at the passive guide member 4*a*, 7*a* the accumulator cooperating with the passive guide member 4*a*, 7*a* may operate. It is noted that the accumulators can safeguard the guide members 4, 7 including the rollers 5 as well as the pile P. Since the contact stresses between the pile P and the rollers 5 are high, in practice the number of the rollers 5 and their diameter will be selected such that the risk of damage is minimized. The accumulators may be omitted in case of fast response times of the hydraulic cylinders. Nevertheless, in practice accumulators may still be applied from point of view of safety.

Under operating conditions, before pile-driving, the eight guide members 4, 7 are retracted towards the wall of the guide sleeve 2 and a pile P is lowered by means of a hoist crane and inserted into the passage 3 of the guide sleeve 2 just above the sea bottom. The passive guide members 4*a*, 7*a* are moved to their fixed guiding positions and the pile P is clamped between the passive guide members 4*a*, 7*a* and the active guide members 4*b*, 7*b* by operating and controlling the cylinders for moving the active guide members 4*b*, 7*b*. The pile P is then lowered into the sea bottom and pile-driving is started. After installing the pile P the guide members 4, 7 are retracted and the pile guide 1 is lifted from the pile P.

FIG. 1 illustrates that the pile P is held between the upper pair of guide members 4*a*, 4*b* and between the lower pair of guide members 7*a*, 7*b* in a direction parallel to an upwardly directed plane. In this case the resultant forces of the cooperating guide members 4*a*, 4*b* of the upper pair and lower pair 7*a*, 7*b* lie in a vertical plane in which the centerline of the pile P lies, as well. At the start of pile driving the passive guide members 4*a*, 7*a* of the upper and lower pair have a mainly fixed guiding position in radial direction of the centerline 6 of the guide sleeve 2 and it is intended to maintain this position during pile driving. As described above the diameter of the pile P may vary along its length and basically it is the active guide member 4*b*, 7*b* which has a variable guiding position in radial direction of the centerline 6 of the guide sleeve 2 in order to compensate for such variations.

In the method the actual forces between the pile P and the respective guide members 4, 7 are measured. The actual forces provide feedback to a control system and on the basis of these signals the hydraulically controlled guide members 4, 7 can be moved to and from the pile P. The method responds to several situations.

For example, if the actual force at the passive guide member 4*a* as well as at the active guide member 4*b* of the cooperating upper pair of guide members 4 exceed respective predetermined threshold levels, the active guide member 4*b* is moved in a direction away from the pile P in order to compensate for a portion of the pile P with increased diameter which passes the pair of upper guide members 4. Basically, the position of the passive guide member 4*a* with respect to the guide sleeve 2 remains unchanged. However, if the actual force at the passive guide member 4*a* of the upper pair 4 remains high in spite of moving the active guide member 4*b* in a direction away from the pile P and the actual force at the active member 4*b* does not increase, the passive guide member 4*a* is moved in a direction away from the pile P. Hence, in practice the method first attempts to compensate for a diameter increase by controlling the position of the active guide member 4*b* only, but also controls the position of the passive guide member 4*a* if required. A similar method of control occurs at the lower pair of guide members 7.

If, for example, during pile driving the actual force at the passive guide member 4*a* of the upper pair of guide members 4 as well as the actual force at the active guide member 7*b* of the lower pair of guide members 7 increase whereas the actual force at the active guide member 4*b* of the upper pair of guide members 4 as well as the actual force at the passive guide member 7*a* of the lower pair of guide members 7 do not increase, all of the guide members 4, 7 remain in their actual position. When the opposite actual forces at diagonally located upper and lower guide members, in this example 4*a* and 7*b*, both increase, the pile P is typically leaning. A similar response of the guide members 4, 7 may be performed if the pile leans in a different direction.

If, for example, during pile driving the actual force at the active guide member 4*b* of the upper pair of guide members 4 decreases, then the active guide member 4*b* of the upper pair of guide members 4 is moved in the direction of the pile P. If the actual force at the passive guide member 4*a* of the upper pair of guide members 4 decreases, then the active guide member 4*b* of the upper pair of guide members 4 is moved in the direction of the pile P, but if the actual force at the passive guide member 4*a* of the upper pair of guide members 4 remains below a predetermined level upon moving the active guide member 4*b* of the upper pair of guide members 4 in the direction of the pile P, then the passive guide member 4*a* of the upper pair of guide members 4 is moved in the direction of the pile P. This situation typically occurs in case of decreasing diameter of the pile P. A similar method of control occurs at the lower pair of guide members 7.

From the foregoing, it will be clear that the invention provides a method for installing a pile in the sea bottom in a fast and accurate manner, whereas resistance between the pile and the guide members is minimized during pile driving.

The invention is not limited to the embodiments shown in the drawings and described hereinbefore, which may be varied in different manners within the scope of the claims and their technical equivalents. For example, it is conceivable that the guide members are moveable by alternative drive means. Furthermore, the passive guide member and the active guide member of a pair of guide members may be out of line in their guiding positions but still facing each other. Moreover, the guide rollers may be replaced by slide pads or the like.

The invention claimed is:

1. A method of installing a pile in the sea bottom by means of a pile guide having a frame and at least an upper and a lower pair of cooperating guide members, wherein the upper pair and the lower pair are located at a distance from each other in a vertical direction, wherein each pair of guide members comprises a passive guide member and an active guide member, the method comprising:

moving each of the passive guide members and the active guide members towards the pile (P) after placing the pile between each of the pairs of guide members, wherein the passive guide members are moved to respective fixed initial guiding positions with respect to the frame and the active guide members are moved to the pile until the passive and the active guide members engage the pile;

driving the pile into the sea bottom while holding the pile between the upper pair of guide members and between the lower pair of guide members;

measuring actual forces between the pile and the respective guide members during driving the pile into the sea bottom;

moving the active guide member of a first of the pairs of guide members in a direction away from the pile without moving the passive guide member of the first pair relative to the pile when the actual forces at both the passive and active guide member of the first pair of guide members increase during driving the pile into the sea bottom; and moving the passive guide member of the first pair in a direction away from the pile if the actual force at the passive guide member of the first pair remains above a certain level without an increase of the actual force at the active member of the first pair during driving the pile into the sea bottom.

2. The method according to claim 1, wherein the guide members are operated hydraulically.

3. The method according to claim 1, wherein locations where resultant forces of the guide members engage the pile lie in a common plane.

4. The method according to claim 1, wherein the passive guide members of both pairs of guide members are located at the same side of the centerline of the pile.

5. The method according to claim 1, wherein the pair of upper guide members form a first pair of upper guide members, wherein a second, similar pair of upper guide members are located in a plane perpendicular to the common plane, and wherein the pair of lower guide members form a first pair of lower guide members, wherein a second, similar pair of lower guide members are located in a plane perpendicular to the common plane.

6. The method according to claim 1, wherein after placing the pile between each of the pairs of guide members, first the passive guide members are moved to respective fixed initial guiding positions with respect to the frame and subsequently the active guide members are moved to the pile until the passive and the active guide members engage the pile.

7. A method of installing a pile in the sea bottom by means of a pile guide having a frame and at least an upper and a lower pair of cooperating guide members, wherein the upper pair and the lower pair are located at a distance from each other in a vertical direction, wherein each pair of guide members comprises a passive guide member and an active guide member, the method comprising:

moving each of the passive guide members and the active guide members towards the pile (P) after placing the pile between each of the pairs of guide members, wherein the passive guide members are moved to respective fixed initial guiding positions with respect to the frame and the active guide members are moved to the pile until the passive and the active guide members engage the pile;

driving the pile into the sea bottom while holding the pile between the upper pair of guide members and between the lower pair of guide members;

measuring actual forces between the pile and the respective guide members during driving the pile into the sea bottom; and locking at least two of the guide members in their positions relative to the pile during driving the pile into the sea bottom if the actual force at one of the guide members of the upper pair and an opposite actual force at one of the guide members of the lower pair both increase and the actual forces at the remaining guide members do not increase.

8. The method according to claim 7, wherein the guide members are operated hydraulically.

9. The method according to claim 7, wherein locations where resultant forces of the guide members engage the pile lie in a common plane.

10. The method according to claim 7, wherein the passive guide members of both pairs of guide members are located at the same side of the centerline of the pile.

11. The method according to claim 7, wherein the pair of upper guide members form a first pair of upper guide members, wherein a second, similar pair of upper guide members are located in a plane perpendicular to the common plane, and wherein the pair of lower guide members form a first pair of lower guide members, wherein a second, similar pair of lower guide members are located in a plane perpendicular to the common plane.

12. The method according to claim 7, wherein after placing the pile between each of the pairs of guide members, first the passive guide members are moved to respective fixed initial guiding positions with respect to the frame and subsequently the active guide members are moved to the pile until the passive and the active guide members engage the pile.

13. A method of installing a pile in the sea bottom by means of a pile guide having a frame and at least an upper and a lower pair of cooperating guide members, wherein the upper pair and the lower pair are located at a distance from each other in a vertical direction, wherein each pair of guide members comprises a passive guide member and an active guide member, the method comprising:

moving each of the passive guide members and the active guide members towards the pile (P) after placing the pile between each of the pairs of guide members, wherein the passive guide members are moved to respective fixed initial guiding positions with respect to the frame and the active guide members are moved to the pile until the passive and the active guide members engage the pile;

driving the pile into the sea bottom while holding the pile between the upper pair of guide members and between the lower pair of guide members;

measuring actual forces between the pile and the respective guide members during driving the pile into the sea bottom;

moving the active guide member of a first of the pairs of guide members in the direction of the pile when the actual force at the active guide member of the first pair decreases during driving the pile into the sea bottom;

moving the active guide member of the first pair in the direction of the pile when the actual force at the passive guide member of the first pair decreases during driving the pile into the sea bottom; and moving the passive guide member of the first pair in the direction of the pile when the actual force at the passive guide member of the first pair remains below a predetermined level after moving the active guide member of the first pair in the direction of the pile.

14. The method according to claim 13, wherein the guide members are operated hydraulically.

15. The method according to claim 13, wherein locations where resultant forces of the guide members engage the pile lie in a common plane.

16. The method according to claim 13, wherein the passive guide members of both pairs of guide members are located at the same side of the centerline of the pile.

17. The method according to claim 13, wherein the pair of upper guide members form a first pair of upper guide members, wherein a second, similar pair of upper guide members are located in a plane perpendicular to the common plane, and wherein the pair of lower guide members form a first pair of lower guide members, wherein a second, similar pair of lower guide members are located in a plane perpendicular to the common plane.

18. The method according to claim 13, wherein after placing the pile between each of the pairs of guide members, first the passive guide members are moved to respective fixed initial guiding positions with respect to the frame and subsequently the active guide members are moved to the pile until the passive and the active guide members engage the pile.

* * * * *